US007666351B2

(12) United States Patent
Nishikawa et al.

(10) Patent No.: US 7,666,351 B2
(45) Date of Patent: Feb. 23, 2010

(54) METHOD OF PRODUCING A MAGNESIUM-ALLOY MATERIAL

(75) Inventors: Taichiro Nishikawa, Osaka (JP); Yoshihiro Nakai, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 217 days.

(21) Appl. No.: 11/631,361

(22) PCT Filed: Jun. 23, 2005

(86) PCT No.: PCT/JP2005/011524
§ 371 (c)(1),
(2), (4) Date: Dec. 29, 2006

(87) PCT Pub. No.: WO2006/003833

PCT Pub. Date: Jan. 12, 2006

(65) Prior Publication Data

US 2007/0231185 A1 Oct. 4, 2007

(30) Foreign Application Priority Data

Jun. 30, 2004 (JP) ..... 2004-194841

(51) Int. Cl.
*C22C 23/04* (2006.01)
*C22C 23/00* (2006.01)
*B22D 11/00* (2006.01)

(52) U.S. Cl. ..... 420/409; 420/402; 420/411; 164/462

(58) Field of Classification Search ..... None
See application file for complete search history.

(56) References Cited

U.S. PATENT DOCUMENTS

| | | | |
|---|---|---|---|
| 4,044,586 | A | 8/1977 | Properzi |
| 2004/0084173 | A1 | 5/2004 | Nishikawa et al. |

FOREIGN PATENT DOCUMENTS

| | | | |
|---|---|---|---|
| DE | 25 37 825 | | 4/1976 |
| EP | 0 257 904 | A2 | 3/1988 |
| JP | 2004-206646 | * | 7/1992 |
| JP | 2000-212607 | * | 8/2000 |
| JP | 2004-124152 | | 4/2004 |
| JP | 2004-124152 | A | 4/2004 |
| JP | 2004-124154 | A | 4/2004 |
| JP | 2004-183062 | A | 7/2004 |
| JP | 2004-217951 | A | 8/2004 |
| WO | WO 02/083341 | A1 | 10/2002 |

OTHER PUBLICATIONS

Supplementary European Search Report issued in European Patent Application No. EP 05753488.5 PCT/JP2005011524, dated on Jan. 4, 2008.

Chinese Office Action, with Partial English Translation, issued in Chinese Patent Application No. CN 2005800291542, dated on Feb. 29, 2008.

Zhang, Qing-lai et al., "Press Forming in AZ31B Wrought Magnesium Alloy," Light Alloy Net Forming National Engineering Research Center, Shanghai China, vol. 32, No. 1, 2004.

T. Nishikawa et al., "Characteristics of magnesium alloy wire rod obtained by continuous casting," (Collected Abstracts of the 2005 Spring Meeting of the Japan Institute of Metals, p. 169 (177) Mar. 29, 2005) and its English translation.

* cited by examiner

*Primary Examiner*—Melvin C Mayes
*Assistant Examiner*—Sarah Van Oudenaren
(74) *Attorney, Agent, or Firm*—McDermott Will & Emery LLP

(57) ABSTRACT

The invention offers (a) a method of producing a magnesium-alloy material, the method being capable of obtaining a magnesium-alloy material having high strength, (b) a magnesium-alloy material having excellent strength, and (c) a magnesium-alloy wire having high strength. A molten magnesium alloy is supplied to a continuous casting apparatus provided with a movable casting mold to produce a cast material. The cast material is supplied to between at least one pair of rolls to perform an area-reducing operation (a rolling operation). The rolling operation is performed such that pressure is applied to the cast material using the rolls from at least three directions in the cross section of the cast material. A magnesium-alloy material obtained through the above-described production method has a fine crystal structure and is excellent in plastic processability.

5 Claims, 2 Drawing Sheets

METHOD OF PRODUCING A MAGNESIUM-ALLOY MATERIAL

RELATED APPLICATIONS

This application is the U.S. National Phase under 35 U.S.C. § 371 of International Application No. PCT/JP2005/011524, filed on Jun. 23, 2005, which in turn claims the benefit of Japanese Application No. 2004-194841, filed on Jun. 30, 2004, the disclosures of which Applications are incorporated by reference herein.

TECHNICAL FIELD

The present invention relates to (a) a magnesium-alloy material having excellent plastic processability and high strength, (b) a magnesium-alloy wire having high strength and excellent toughness, and (c) a method of producing a magnesium-alloy material, the method being most suitable for obtaining the foregoing magnesium-alloy material and wire.

BACKGROUND ART

Magnesium has a specific gravity (a density in g/cm$^3$ at 20° C.) of 1.74 and is the lightest metal among the metals used as a structuring material. Consequently, in recent years, cases have been increasing where it is used as a material for portable apparatuses and motorcar components, both of which are required to be light-weight. As the currently employed method of producing a magnesium-alloy product, the injection casting process is mainly used, such as the die casting process, the thixomolding process, and another injection molding process.

In addition, a magnesium-alloy material having higher strength can be obtained by performing a plastic processing on a billet-shaped cast material obtained through the semi-continuous casting process such as the direct-chill (DC) casting process. However, a cast material obtained by the semi-continuous casting process has a large crystal-grain diameter. Therefore, it is difficult to perform the plastic processing, such as forging, drawing, and rolling, without a pretreatment. Consequently, it is known that it is necessary to heat the cast material again to carry out the extrusion operation under the hot condition in order to obtain fine crystal grains before performing the above-described plastic processing. The performing of such a hot extrusion increases the number of processes. In addition, the productivity decreases greatly because a magnesium alloy is an active metal and therefore it is necessary to determine the extrusion speed so that sufficient cooling can be performed at the time of the extrusion. In view of the above circumstances, Patent literature 1 has disclosed that the employment of the continuous casting using a movable casting mold enables the performing of the hot rolling without carrying out the extrusion operation in advance. On the other hand, Patent literature 2 has disclosed that a rolled wire can be obtained by rolling an ingot of magnesium alloy using grooved rolls under a specific rolling temperature condition.

Patent literature 1: Internationally published pamphlet 02/083341

Patent literature 2: the published Japanese patent application Tokukai 2004-124152.

DISCLOSURE OF THE INVENTION

Problem to be Solved

As described in Patent literature 1, the performing of the continuous casting enables the hot rolling without carrying out the extrusion operation. However, the rolling operation disclosed in Patent literature 1 is intended to obtain a sheet material having excellent pressing processability. It does not state for a rod-shaped body. Patent literature 2 uses an ingot without studying about the continuous casting. As described above, sufficient study so far has not been conducted on the technique to obtain a magnesium-alloy material, especially a long rod-shaped body, having excellent strength and toughness.

In view of the above circumstances, a principal object of the present invention is to offer a method of producing a magnesium-alloy material, the method being capable of obtaining a magnesium-alloy material having excellent mechanical properties. Another object of the present invention is to offer a magnesium-alloy material having excellent strength and a magnesium-alloy wire having high strength and excellent toughness.

Means to Solve the Problem

The present invention attains the foregoing object by performing a rolling operation on a continuously cast material such that pressure is applied from at least three directions in the cross section of the material.

More specifically, according to the present invention, a method of producing a magnesium-alloy material comprises (a) a casting step for obtaining a cast material by supplying a molten magnesium alloy to a continuous casting apparatus provided with a movable casting mold and (b) a rolling step for performing an area-reducing operation by supplying the cast material to one member selected from the group consisting of at least one roll group and at least one roll pair. In this case, the rolling is performed by applying pressure using the rolls from at least three directions in the cross section of the cast material.

The present invention is explained below in detail. The types of the movable casting mold to be used in the production method of the present invention include (1) a mold comprising a pair of belts represented by the twin-belt method and (2) a mold comprising a combination of a plurality of rolls (wheels) and a belt represented by the wheel-and-belt method. In these movable casting molds using a roll and/or belt, the surface making contact with the molten metal emerges continuously. Consequently, it is easy to obtain a smooth surface of the cast material, and the maintenance work becomes easy. The movable casting mold described in (2) above is composed of, for example, (a) a casting roll provided with a groove into which the molten metal is fed, the groove being formed at the surface portion (the surface that makes contact with the molten metal) of the roll, (b) a plurality of trailing rolls that follow the casting roll, and (c) a belt placed so as to cover an opening of the groove so that the molten metal fed into the groove can be prevented from flowing off. In addition, a tension roller may be combined to the movable casting mold to adjust the tension of the belt. It is desirable that the belt be placed so as to form a closed loop through between the rolls and over the surface of the rolls.

When this method is employed, the following advantage can be achieved. That is, when the moving speed is adjusted in accordance with both the flow rate of the molten metal and the cross-sectional area of the movable casting mold (the cross-sectional area of the portion enclosed by the groove of the casting roll and the belt), not only can the solidifying surface of the molten metal be maintained fixed but also the cooling rate at which the molten metal is solidified can be easily maintained constant.

The use of the continuous casting apparatus provided with the above-described movable casting mold enables the production of a long cast material whose length is infinite in theory. Therefore, the mass production of the cast material becomes possible. In addition, as described above, the performing of the continuous casting enables the obtaining of a cast material having not only excellent surface property but also longitudinally uniform high quality, in particular. In comparison with a billet-shaped cast material obtained by the semicontinuous casting process and an ingot obtained by the injection casting process, a cast material obtained by the continuous casting process is advantageous in the following points. That is, because the cooling in the cross section becomes uniform, its crystal-grain diameter is small and therefore it has a fine crystal structure. In addition, it decreases the tendency to form coarse precipitated-out substances that become a starting point of cracking. As a result, a cast material obtained by the continuous casting process decreases the tendency to form cracking and other defects in the following rolling step. Consequently, the rolling operation can be performed sufficiently. In addition, the obtained rolled material is suitable for plastic processing such as drawing and forging.

It is desirable that the foregoing cast material have a cross section whose minor axis is 60 mm or less, in particular. When the minor axis is 60 mm or less, the cooling rate at the cross section of the cast material is increased. Consequently, the size of the precipitated-out substances formed at the time of the casting can be decreased to 20 μm or less. In other words, the obtained cast material can have a finer crystal structure. As a result, the obtained cast material can become a material more suitable for rolling and the plastic processing performed after the rolling.

In order to increase the cooling rate at the time of casting, it is desirable that the continuous casting process be performed either by the twin-belt method or the wheel-and-belt method. In addition, it is desirable that in the movable casting mold, at least the portion that makes contact with the molten metal (i.e., the surface of the groove formed in the roll and the belt's surface that makes contact with the molten metal) be formed with a material having high thermal conductivity, such as any of iron, iron alloy, copper, and copper alloy.

A magnesium alloy is an extremely active metal. Therefore, it may burn by easily reacting with oxygen in the air at the time of the melting of it. In order to effectively prevent the reaction of a magnesium alloy with oxygen, it is desirable that the melting be performed under the enclosed condition that is produced by filling the melting furnace with an inert gas, such as argon gas, or a mixed gas of air and sulfur hexafluoride ($SF_6$) gas for burning prevention, or the like. To achieve an effect of burning prevention by using the foregoing mixed gas, it is recommended that air be mixed with 0.1 to 1.0 vol. % $SF_6$ gas.

In addition to the time of melting, a magnesium alloy may also react with oxygen in the air at the time of casting. For example, at the time of the pouring of the molten metal into the movable casting mold, more specifically, in the vicinity of the hole for pouring the molten metal, the molten metal may burn resulting from the reaction of the magnesium alloy with oxygen in the air. Furthermore, when the magnesium alloy is cast into the mold, the alloy sometimes partially oxidizes simultaneously, thereby turning black the surface of the cast material. Consequently, it is desirable that even the vicinity of the hole for pouring the molten metal and the movable casting mold portion be enclosed by being filled with such a gas as an inert gas, such as argon gas, or a mixed gas of air and a burning prevention gas, such as $SF_6$ gas. When a shielding gas, such as the foregoing inert gas or air containing a burning prevention gas (a mixed gas), is not used, it is recommended that the hole for pouring the molten metal have an enclosed structure in which the mouth has the same shape as the cross-sectional shape of the movable casting mold. This structure prevents the molten metal from making contact with the outside air in the vicinity of the hole for pouring the molten metal. As a result, the burning and oxidation of the molten metal can be decreased to obtain a cast material having a good surface condition.

In addition, when a magnesium alloy added with an element having an effect of burning protection and oxidation protection is used, the same effect as that obtained when the shielding gas is used can also be obtained. More specifically, the types of the foregoing magnesium alloy include a magnesium alloy added with 0.002 to 5.0 wt. % Ca. The use of a magnesium alloy containing a specific amount of Ca decreases the tendency to burn and oxidize at the time of, for example, the melting and the flowing into the movable casting mold, even when a shielding gas is not used. Consequently, the black turning due to the partial oxidation of the surface of the cast material can be effectively prevented. If the Ca content is less than 0.002 wt. %, the effect of preventing the burning and oxidation will be not sufficient. If it is more than 5.0 wt. %, this large amount will cause the generation of cracking at the time of casting and rolling. In particular, it is desirable that the Ca content be at least 0.01 wt. % and at most 0.1 wt. %. Even when the hole for pouring the molten metal is designed to have an enclosed structure in which the hole has the same shape as the cross-sectional shape of the movable casting mold, the adding of Ca to the magnesium alloy can effectively prevent the black turning due to partial oxidation of the cast material. In this case, the amount of 0.002 to 0.05 wt. % is suitable as the Ca content. In order to prevent the black turning due to oxidation and the cracking at the time of, for example, casting without relying on the presence of the shielding gas and on the shape of the hole for pouring the molten metal, it is more desirable that the Ca content be at least 0.01 wt. % and at most 0.05 wt. %.

As described above, the use of the shielding gas and the use of the magnesium alloy added with the oxidation-preventing element not only suppress the burning and oxidation of the magnesium alloy at the time of the melting and casting but also decrease the black turning due to partial oxidation of the surface of the cast material. The thus obtained cast material is nearly or completely free from black-turned portions due to partial oxidation at the surface. Consequently, the cast material has a decreased tendency to create cracking or other defects originating from the black-turned portions in the rolling step subsequent to the casting.

Next, according to the production method of the present invention, the cast material obtained by the above-described continuous casting is processed by rolling. More specifically, the cast material is supplied to between at least one pair of rolls (rolling rolls) to undergo pressure application with the rolls for the processing of area reduction. In particular, in the production method of the present invention, a bar-shaped body is obtained by the rolling. In this case, unlike the case where a sheet material is obtained by rolling (rolls are applied to the cross section of the material to be rolled from only two directions), in the production method of the present invention, the rolling is performed by applying rolls to the cross section of the cast material from at least three directions. Such a rolling operation is performed by the following methods, for example: (a) The use of a group of rolls in which three rolls are combined in a triangular form, and (b) A plurality of roll pairs are prepared. In each pair, the rolls are placed in the opposite positions. The roll pairs are placed at different places along the advancing direction of the rolling (the direction of the length of the material to be rolled) such that the center line of the gap between the rolls in one pair is oriented differently from another pair.

In the case of (a) above, in which a group of rolls combined in a triangular form are used, pressure is applied to the cast material (the material to be rolled) from three directions at the same place along the advancing direction of the rolling (the direction of the length of the material to be rolled). It is desirable to prepare a plurality of such roll groups and to place the roll groups at different places along the advancing direction of the rolling such that the orientations of the triangles differ from one another, because the pressure is applied uniformly onto the circumferential surface of the cast material (the material to be rolled). In addition, when a plurality of roll groups are placed at different places along the advancing direction of the rolling, a rolled material having an intended size (cress-sectional area) can be obtained.

In the case of (b) above, in which a plurality of roll pairs are used and the roll pairs are placed such that when viewed from a front position in the advancing direction of the rolling, the center line of the gap between the rolls of one pair crosses that of another pair. When the roll pairs are placed as described above, pressure is applied by the rolls to the cast material (the material to be rolled) from at least four directions (two directions at two or more places) at different places along the advancing direction of the rolling (the direction of the length of the material to be rolled). For example, two roll pairs are prepared. In one roll pair, the rolls are placed such that the center line of the gap between the rolls is oriented horizontally, and in the other roll pair, the rolls are placed such that the center line of the gap between the rolls is oriented vertically. In this case, one roll pair applies the pressure to the cast material (the material to be rolled) from two directions (i.e., from left and right), and the other roll pair applies the pressure to the cast material from different two directions (i.e., from above and down). When a plurality of such roll pairs are prepared and placed at different places along the advancing direction of the rolling (the direction of the length of the material to be rolled), a rolled material having an intended size (cross-sectional area) can be obtained.

It is desirable that the above-described rolling be a hot rolling. A magnesium alloy has a hexagonal close-packed (hcp) structure, which has poor processability at room temperature or so. Therefore, to improve the plastic processability, it is desirable to heat the cast material for the rolling operation. More specifically, it is desirable that the temperature of the cast material be at least 100° C. and at most 500° C. If the processing temperature is less than 100° C., cracking may be created on the surface of the magnesium-alloy material (which is under the rolling operation) during the rolling, rendering the rolling impossible. On the other hand, if the processing temperature is more than 500° C., not only may the surface of the material be oxidized during the rolling to turn black but also heat generation and another undesirable phenomenon accompanying the processing may burn the material in the course of the processing. In particular, it is desirable that the processing temperature be at least 150° C. and at most 400° C. The heating of the cast material may be performed by either of the following two methods:

(a) a method of heating the cast material directly by using a heating means such as a heater or a high-frequency induction heater, and (b) a method of heating the cast material indirectly by using a heated rolling roll that is provided with a heating means such as a heater.

In addition, even when the cast material is heated directly, the rolling roll may be provided with a heating means so as to be operated under heated condition. When this system is employed, the magnesium-alloy material in contact with the rolling roll decreases the tendency to cool itself, further facilitating the rolling operation.

The rolling step may be performed immediately after the casting step as a continuous step. The continuous operation of the casting step and rolling step enables the utilization of the remaining heat in the casting step. Consequently, the consumption of the heat energy can be decreased at the time of the heating of the cast material in the rolling step. As a result, the continuous operation can not only decrease the load of the heating means that directly heats the cast material and the heating means that is provided in the rolling roll but also reduce the cost. In addition, the utilization of the remaining heat in the casting step can not only bring the cast material to a sufficiently heated state but also decrease the variations in the temperature of the cast material. Therefore, because the rolling condition, such as the pressure, is stabilized, the cracking and other defects in the material at the time of the rolling can also be decreased. Furthermore, when the continuous casting apparatus and the rolling apparatus are linearly arranged so that the cast material can be linearly supplied to the rolling apparatus, the application of bending and other undesirable effects onto the cast material is decreased at the time of the supply. As a result, the surface cracking of the material due to bending can be prevented. When the rolling is performed immediately after the casting, a heating means, such as a heater or a high-frequency induction heater, may be placed between the continuous casting apparatus and the rolling apparatus provided with the foregoing rolling roll so that the cast material can be heated.

The rolling step may conduct a plurality of passes by providing multiple stages of the above-described roll group or roll pair or the like. In this case, it is desirable that the total reduction of area be at least 20%. In particular, it is desirable that the total reduction of area be at least 50%. When the processing is performed at a total reduction of area of at least 20%, the cast structure of the magnesium alloy disappears nearly completely and the structure becomes any one of (a) a hot-rolled structure, (b) a mixed structure composed of a hot-rolled structure and a recrystallized structure, and (c) a recrystallized structure. All of these structures are a fine crystal structure (the average crystal grain diameter is at most 50 μm). Consequently, the obtained rolled material has excellent plastic processability for a drawing operation and a forging operation, for example. Therefore, when such a rolled material is further processed by drawing or forging or the like, a magnesium-alloy material can be easily obtained, such as a wire and a forged material. In the case of the recrystallized structure, when the average crystal grain diameter is 30 μm or less, in particular, the drawing processability and the forging processability are further improved. To improve the plastic processability of the rolled material, it is recommendable to obtain a finer crystal structure. To further decrease the average crystal grain diameter, it is recommendable to increase the total reduction of area. On the other hand, if the total reduction of area is less than 20%, the crystal structure of the rolled material remains to be the cast structure, which has a large crystal grain diameter. As a result, such a rolled material tends to have a poor plastic processability in the processing to be performed after the rolling, such as drawing and forging.

It is desirable that the rolled material produced by the above-described continuous casting and rolling have a tensile strength of 200 MPa or more. In particular, it is desirable that the tensile strength be 250 MPa or more. The rolled material having such a high strength can improve the processability in a plastic processing such as drawing and forging. If the tensile strength is less than 200 MPa, the foregoing plastic processability tends to decrease. Consequently, in comparison with the magnesium-alloy material obtained by the injection casting process, such as the die casting and the thixomolding, and the semicontinuous casting process, the rolled material loses the advantage in strength. The tensile strength can be varied by controlling the rolling conditions. For example, the tensile strength can be controlled by properly selecting not only the rolling temperature and the reduction of area in one pass but also the total reduction of area.

A magnesium-alloy material of the present invention obtained by the foregoing continuous casting and rolling can be long bodies (bar-shaped bodies) having various cross-sectional shapes by variously changing the shape of the rolling roll. For example, it can have a multiangular bar shape or a circular bar shape.

When the above-described continuously cast and rolled material is further processed by plastic processing such as drawing and forging, a magnesium-alloy material having higher strength can be obtained. The magnesium-alloy material obtained by further performing plastic processing on a continuously cast and rolled material, as described above, has a higher strength than (a) a cast material produced by the casting other than the continuous casting and (b) a rolled material produced by rolling the cast material just described in (a) above. Consequently, when the alloy material of the present invention is used to produce component parts or the like, it can produce a small, thin component, thereby enabling not only a decrease in the number of alloy materials but also a further decrease in the weight of the component. In other words, the present invention can offer at low cost a magnesium-alloy material for flattened or expanded materials. In addition, as described above, a magnesium-alloy material of the present invention obtained through the continuous casting and rolling has a plastic processability superior to that of an extruded material and consequently has a large degree of freedom in shape. Therefore, various shapes can be drawn. For example, when a drawing operation is performed on an alloy material of the present invention, by using a specially formed die or roller, a specially formed wire (a linearly shaped body) can be obtained whose cross section is not only circular but also noncircular such as elliptical, rectangular, polygonal, and so on. Furthermore, when a drawing operation is performed on an alloy material of the present invention with dies placed in multiple stages, a wire having a diameter as small as 5 mm or less can be obtained.

A wire obtained by performing a drawing operation on an alloy material of the present invention obtained through the continuous casting and rolling can have a strength higher than that of a wire obtained by performing a drawing operation on an extruded material produced by extruding an injection cast material or a semicontinuously cast material. This is attributable to the fact that because the cooling rate at the time of the continuous casting is sufficiently higher than that of the injection casting and semicontinuous casting, the concentration of the solid solution of the below-described added elements becomes relatively high. In addition, because a wire obtained by drawing also has excellent plastic processability, another plastic processing such as forging can be further performed. In other words, the wire can be used as a material for forging operation.

In the present invention, a magnesium alloy is defined as an alloy that contains an added element other than Mg and the remainder composed of Mg and impurities. The use of a magnesium alloy containing an added element other than Mg can improve the strength, elongation, high-temperature strength, resistance to corrosion, and so on of (a) a rolled material produced by the continuous casting and rolling and (b) a processed material produced by a plastic processing after the continuous casting and rolling. The types of such an element to be added include Al, Zn, Mn, Si, Cu, Ag, Y, and Zr. It is desirable that the total content of the added elements be 20 wt. % or less. If the total content of the added elements is more than 20 wt. %, cracking and other defects in the material may be caused at the time of casting. More specific compositions are shown below, for example:

(a) a 5 to 15 wt. % element other than Mg and the remainder of Mg and impurities, (b) 0.1 to 12 wt. % Al and the remainder of Mg and impurities, (c) 0.1 to 12 wt. % Al; at least one constituent selected from the group consisting of 0.1 to 2.0 wt. % Mn, 0.1 to 5.0 wt. % Zn, and 0.1 to 5.0 wt. % Si; and the remainder of Mg and impurities, and (d) 0.1 to 10 wt. % Zn, 0.1 to 2.0 wt. % Zr, and the remainder of Mg and impurities.

The impurities may either be only the elements contained unintentionally or contain intentionally added elements (the added elements).

As the foregoing alloy composition, the family expressed in the representative symbol in the American Society for Testing and Materials (ASTM) Specification such as the AZ, AS, AM, and ZK families may be used. More specifically, the types of the AZ family include AZ10, AZ21, AZ31, AZ61, AZ80, and AZ91, for example. The types of the AS family include AS21 and AS41, for example. The types of the AM family include AM60 and AM100, for example. The types of the ZK family include ZK40 and ZK60, for example. The Al content may either be as low concentration as 0.1 wt. % to less than 2.0 wt. % or as medium or high concentration as 2.0 to 12.0 wt. %.

A magnesium alloy having an added element other than Mg with a content of 5 wt. % or more has a tendency to improve the strength in comparison with the case where the content of the added element is less than 5 wt. %. Consequently, when such an alloy is used as the material, the effect of decreasing the weight is great. For example, AZ61, AZ80, and AZ91 alloys have a strength superior to that of an AZ31 alloy. The types of such an added element include at least one element selected from the group consisting of Al, Zn, Mn, Si, Zr, and Y. It is desirable to contain these elements with a total content of 5 wt. % or more, particularly desirably 9 wt. % or more. In addition, when the content of the added elements other than Mg is increased, it can be expected to further improve the high-temperature strength and resistance to corrosion. As for the resistance to corrosion, when the Al content is 8 wt. % or more, the effect is particularly great. Such a magnesium alloy can have a resistance to corrosion comparable to that of an Al alloy. Furthermore, when an alloy contains yttrium with the above-described content range, the alloy can have excellent tensile strength and high-temperature strength.

On the other hand, in the case of the magnesium alloy containing added elements with high concentration as described above, when the semicontinuous casting process, such as DC casting, is performed, precipitated-out substances as large as several tens of micrometers or so tend to be included. Such coarse inclusions will cause the creation of cracking at the time of (a) the rolling operation after the casting and (b) the plastic processing after the rolling operation, thereby decreasing the productivity considerably. On the other hand, in the present invention, because the continuous casting is performed using a movable casting mold, it is easy to increase the rate of cooling at the time of casting. More specifically, a rate of 1° C./sec or more, in particular, 10° C./sec or more, can be easily achieved. As a result, the size of the precipitated-out substances can be decreased to 20 μm or less, in particular, 10 μm or less. Therefore, by performing the continuous casting as in the present invention, even a magnesium-alloy material containing a high concentration of added elements can produce a cast material that has nearly no possibility of creating cracking that originates from the above-described precipitated-out substance during (a) the rolling operation after the casting and (b) the plastic processing after the rolling operation. In addition, in the case of the continuous casting, as described above, the amount of the solid solution of the added element will increase after the casting. Consequently, even when the processing temperature for the rolling after the casting is increased to as high as 350° C. or more, the tendency to coarsen the crystal grain will be decreased. As a result, the obtained rolled material has excellent plastic processability, facilitating the plastic processing after the rolling. More over, this obtained rolled material has, as described above, a fine and uniform crystal structure (not the cast structure). This fact also gives superior plastic processability to this material. The added element has such various effects. Nevertheless, as described above, when it is added excessively, the material will increase the tendency to generate cracking and other defects. Therefore, it is desirable that the content of the added element be 20 wt. % or less, particularly desirably 15 wt. % or less.

In addition, it is desirable that 0.002 to 5.0 wt. % Ca be added to the above-described composition, because the material can be prevented from burning and oxidizing at the time of, for example, the melting and the casting, as described above.

EFFECT OF THE INVENTION

As explained above, the production method of the present invention carries out a rolling operation on a cast material produced by the continuous casting such that pressure is applied from at least three directions in the cross section of the material. This method can offer a specific effect that a magnesium-alloy material can be obtained that has excellent mechanical properties such as strength. In particular, a long magnesium-alloy material can be obtained that has a decreased tendency to produce cracking and other defects during the casting and rolling and that has an excellent surface property over its length.

In addition, the containment of a specified amount of element for preventing burning can effectively prevent the burning and oxidation of the material at the time of the melting, the pouring of the molten metal, and the casting.

A magnesium-alloy material of the present invention obtained through the above-described continuous casting and rolling has a fine structure. Consequently, it is excellent in plastic processability and therefore can undergo plastic processing such as drawing and forging. A magnesium-alloy material of the present invention having undergone the plastic processing has high strength and high toughness and is lightweight. Because it has these features, it can be used in various fields. In addition, a magnesium-alloy material of the present invention having undergone a plastic processing can be further processed by forging and the like. In other words, a magnesium-alloy material of the present invention can be used as a material for forging, for example.

BEST MODE FOR CARRYING OUT THE INVENTION

Embodiments of the present invention are explained below.

Test Example 1

A cast material was produced by performing a continuous casting on a molten magnesium alloy using a wheel-and-belt-type continuous casting apparatus. The obtained cast material was examined to clarify the surface property and the structure.

The magnesium alloy used in this test was an AZ31 alloy equivalent material. Its composition was analyzed by chemical analysis. The result was shown in wt. % as follows: Al: 3.0%, Zn: 1.0%, Mn: 0.15%, and the remainder: Mg and impurities including 0.0013% Ca, which was not added intentionally.

FIG. 1 shows a continuous casting apparatus used in this test. FIG. 1 emphasizes a cast material 1 in showing it. This is also applicable to FIG. 2 described below. A continuous casting apparatus 10 comprises (a) a casting roll 11 provided with a groove ha into which a molten metal is poured, the groove 11*a* being formed at the surface portion that makes contact with the molten metal, (b) two trailing rolls 12*a* and 12*b* that move following the casting roll 11, (c) a belt 13 provided so as to cover an opening of the groove 11*a* so that the molten metal poured into the groove 11*a* can be prevented from flowing out, and (d) a tension roll 12*c* for adjusting the tension of the belt 13. In this example, as shown in FIG. 1(A), the trailing rolls 12*a* and 12*b* are placed at the opposite positions in terms of the casting roll 11. The tension roll 12*c* is placed behind the three rolls 11, 12*a*, and 12*b* (the right-hand side in FIG. 1(A)). The belt 13 is placed so as to form a closed loop by circulating it between the rolls 11 and 12*a*, between the rolls 11 and 12*b*, and over the circumference of the roll 12*c*. In this structure, when the casting roll 11 rotates in a direction shown by an arrow, the rolls 12*a* to 12*c* rotate in turn through the belt 13. A supplying section (nozzle) 14 is placed between the casting roll 11 and the trailing rolls 12*a*. The supplying section 14 is provided with a hole for pouring the molten metal (a spout) to which the molten metal is fed from a melting furnace (see FIG. 2 described below). The molten metal fed from the melting furnace to the supplying section 14 flows into the groove 11*a* of the casting roll 11 through the hole for pouring the molten metal. The opening is covered with the belt 13. Thus, the cast material 1 having a rectangular cross section as shown in FIG. 1(B) is obtained.

In this example, the surface portion of the groove 11*a* with which the molten metal makes contact was formed with SUS430, which has excellent resistance to heat. The groove 11*a* had a cross-sectional area of about 300 $mm^2$ (width: 18 mm, height: 17 mm). The belt 13 was formed of pure copper (C1020) and had a thickness of 2 mm. Furthermore, in this example, cooling water was fed to the inside of the casting roll 11 so that the roll 11 could be cooled. In this example, the flow rate or the cooling water was set to be 30 liter/min. In addition, in this example, the hole for pouring the molten metal, which was provided at the supplying section 14, was designed to have the same cross-sectional shape as that of the groove 11*a* of the casting roll 11. What is more, the section between the hole for pouring the molten metal and the casting roll 11 was made to be an enclosed structure, so that the molten metal in this section could not make contact with the outside air.

In this example, the melting furnace had a mixed-gas atmosphere in which air is mixed with 0.2 vol. % $SF_6$ gas. The magnesium alloy having the above-described alloy composition was melted at 700 to 800° C. A molten metal composed of the magnesium alloy was poured into a tundish through a launder heated at about 500° C. Then, the molten metal was fed from the tundish and was poured into the movable casting mold through the supplying section and the hole for pouring the molten metal to perform the continuous casting at a speed of 3 m/min. In this example, because the melting of the magnesium alloy was conducted in an atmosphere having mixed $SF_6$ gas, problems such as combustion of the alloy during the melting were not created. Although a mixed gas of $SF_6$ gas and air was used in this example, an inert gas such as argon gas may be employed to fill the melting furnace with an inert atmosphere.

The cross section of the obtained cast material was examined under an optical microscope. Although precipitated-out substances were observed, their size was 10 μm at the most. It had a fine crystal structure. However, it was found that in the obtained cast material, only a small part of the surface was turned black due to oxidation. This is attributable to the fact that although Ca was unavoidably contained in the magnesium alloy, because only the section between the hole for pouring the molten metal and the casting roll was made to be an enclosed structure, the molten metal was brought into contact with outside air at a place such as the launder portion, so that the molten metal was oxidized. In view of the above result, another cast material containing Ca was produced by adding 0.01 wt. % Ca to the foregoing alloy structure and by carrying out the continuous casting under the same condition as above. When the surface of the Ca-containing cast material was examined, no black turning due to oxidation was observed. In addition, by varying the Ca content, cast materials were produced by carrying out the continuous casting under the same condition. The examination of the surface property revealed that as the Ca content increases, the cast material decreases the tendency to be oxidized. Nevertheless, when the Ca content exceeds 5 wt. %, it was observed that some cast materials created surface cracking. The result shows that when a magnesium alloy is used that contains a specific amount of Ca, the oxidation can be prevented effectively without producing surface cracking.

Test Example 2

The continuous casting apparatus (see FIG. 1(A)) used in Test example 1 above was provided, in the vicinity of it, with a rolling apparatus comprising pairs of rolls. A cast material obtained by the continuous casting was subjected to a rolling operation directly after the casting operation to produce a rolled material. The magnesium alloy used in this test was produced by adding 0.01 wt. % Ca to the AZ31 alloy equivalent material used in Test example 1 above.

FIG. 2 shows a production line used in this test. The line comprises a continuous casting apparatus and a rolling apparatus. In FIG. 2, the same sign as used in FIG. 1 shows the same item. This production line is provided with the following units in this order for the production: a melting furnace 15, a continuous casting apparatus 10, (guide rolls 40), a heating means 30, a rolling apparatus 20, and a take-up device 50. The continuous casting apparatus 10 and the rolling apparatus 20 were placed such that the cast material 1 having left the continuous casting apparatus 10 is linearly introduced into the rolling apparatus 20. The rolling apparatus 20 comprises linearly arranged four two-stage rolling machines 20A to 20D, each of which is provided with two rolling-roll pairs 21*a* and 21*b*. In each of the two-stage rolling machines 20A to 20D, the two rolling-roll pairs are placed such that the center line of the gap between the rolls 21 of one pair is oriented to a direction different from that of the other pair (the two center lines cross each other). More specifically, of the two rolling-roll pairs, in the rolling-roll pair 21*a*, the rolls 21 are placed such that the center line of the gap between the rolls 21 is oriented horizontally, and in the other rolling-roll pair 21*b*, the rolls 21 are placed such that the center line of the gap between the rolls 21 is oriented vertically. In other words, the rolling-roll pair 21*a* was placed in the vertical position (the up-and-down position in FIG. 2) to the cast material 1. On the other hand, the rolling-roll pair 21*b* was placed in the horizontal position (the position perpendicular to the sheet of paper in FIG. 2) to the cast material 1. Each of the rolling-rolls 21 was provided with a heater (not shown) at the inside of it to enable the heating of the rolling-roll 21. In addition, because the temperature of the cast material 1 in the vicinity of the exit of the continuous casting apparatus 10 became about 150° C., the heating means 30 was placed in front of the rolling apparatus 20. As a result, it was possible to directly heat the cast material 1 using the heating means 30 before the rolling operation. In this example, as the heating means 30, a high-frequency induction heater was used.

As with Test example 1, the melting furnace 15 had a mixed-gas atmosphere in which air is mixed with 0.2 vol. % $SF_6$ gas. A magnesium alloy containing Ca was melted at 700 to 800° C. in the furnace 15. The obtained molten metal was poured into a tundish 17 through a launder 16 heated at about 500° C. The molten metal was fed from the tundish 17 to the supplying section 14, to the hole for pouring the molten metal, and to the continuous casting apparatus 10 to obtain a cast material 1 (cross-sectional area: about 300 $mm^2$). The casting speed was set to be 3 m/min. Subsequently, the obtained cast material 1 was sent to the heating means 30 through the guide rolls 40 to heat the cast material 1 up to about 400° C. The heated cast material 1 was then sent to the rolling apparatus 20 to be processed by rolling. In this example, the rolling operation was performed while the individual rolling rolls 21 were being heated at 150° C. with the heater. In each of the rolling machines 20A to 20D, the reduction of area was set to be 15% to 20%. The total reduction of area was about 56%. The obtained rolled material 2 was a long body (a rod-shaped body) having a circular cross section with a diameter of 13 mm. The long body was wound up with the take-up device 50.

The thus obtained continuously cast and rolled material was subjected to the observation under an optical microscope. When its structure was examined at the cross section, the cast structure disappeared completely and the structure was composed of a hot-rolled structure and a recrystallized structure. The average crystal grain diameter of the rolled material was measured to be 20 μm. Although precipitated-out substances were observed in the rolled material, their size was 10 μm at the most. The tensile strength of the rolled material was measured to be 250 MPa. In other words, it was confirmed that the material had a strength that satisfied the desirable value of 200 MPa or more.

A specimen having a diameter of 8 mm and a length of 12 mm was taken from the above-described continuously cast and rolled material. The specimen was subjected to a hot upsetting at a temperature of 300° C. (upsetting speed: 12 mm/sec, upsetting rate: 70% (height: 3.6 mm)). The result showed that the upsetting was successfully performed without creating cracking and another defect on the surface of the specimen. On the other hand, for comparison, a commercially available extruded material (diameter: 8 mm, length: 12 mm) made of an AZ31 alloy was also subjected to the hot upsetting under the same condition. The result showed that the processing at an upsetting rate of 70% created surface cracking. When the crystal structure at a cross section of the extruded material was examined under an optical microscope, precipitated-out substances having a size of about 30 μm were observed. Therefore, the precipitated-out substances are considered to be the cause of the cracking.

Test Example 3

The continuously cast and rolled material obtained in Test example 2 (the long body having a diameter of 13 mm) was processed by drawing using drawing dies to obtain a wire. The strength and toughness of the wire were examined. In this test, the processing temperature was set to be 200° C., and the reduction of area for one pass was 10% to 15%. In every two to three passes, a heat treatment was conducted at 300° C. for 30 min. Thus, a wire was obtained that had a circular cross section with a diameter of 2.8 mm (total reduction of area: about 95%) The tensile strength and elongation of the obtained wire were examined. The wire had a tensile strength of 310 MPa and an elongation of 15%. In other words, the wire was excellent in both strength and toughness. The number of breakings of the wire during the drawing operation was 0.5 times per kg.

For comparison, a commercially available extruded material (diameter: 13 mm) made of an AZ31 alloy was also processed by drawing under the same condition as above to obtain a wire having a diameter of 2.8 mm. The tensile strength and elongation of the obtained wire were examined. The wire had a tensile strength of 290 MPa and an elongation of 15%. As described above, the result showed that the wire produced by using the continuously cast and rolled material had a property superior to that of the extruded wire. In addition, when the extruded wire was used, the number of breakings of the wire during the drawing operation was 2.0 times per kg. This result showed that the use of the continuously cast and rolled material is superior in drawing processability. In other words, the above test confirmed that the use of the continuously cast and rolled material can improve the tensile strength without reducing the elongation.

Test Example 4

Magnesium alloys were prepared that had a composition different from that of the magnesium alloy used in the above-described Test examples. Using the prepared magnesium alloys, continuously cast and rolled materials were produced through the same method as above. The compositions of the alloys used are shown below.

(Alloy Composition)

An AM60 alloy (a magnesium alloy): Al: 6.1 wt. %, Mn: 0.44 wt. %, and the remainder: Mg and impurities.

An AZ61 alloy (a magnesium alloy): Al: 6.4 wt. %, Zn: 1.0 wt. %, Mn: 0.28 wt. %, and the remainder: Mg and impurities.

An AZ91 alloy (a magnesium alloy): Al: 9.0 wt. %, Zn: 1.0 wt. %, and the remainder: Mg and impurities.

A ZK60 alloy (a magnesium alloy): Zn: 5.5 wt. %, Zr: 0.45 wt. %, and the remainder: Mg and impurities.

A Y-containing alloy (a magnesium alloy): Zn: 2.5 wt. %, Y: 6.8 wt. %, and the remainder: Mg and impurities.

Alloys produced by further adding 0.01 wt. % Ca individually to the foregoing AM60 alloy, AZ61 alloy, AZ91 alloy, ZK60 alloy, and Y-containing alloy.

The thus obtained individual continuously cast and rolled materials were subjected to the examination under an optical microscope. When their structure was examined at the cross section, in all of the rolled materials, the cast structure disappeared completely and the structure was composed of any one of (a) a hot-rolled structure, (b) a mixed structure having a hot-rolled structure and a recrystallized structure, and (c) a recrystallized structure. The average crystal grain diameter of these rolled materials was measured to be 5 to 20 μm. The maximum grain diameter of the precipitated-out substances was 3 to 10 μm. In other words, they had a fine structure. In addition, all of the continuously cast and rolled materials had a tensile strength of 200 MPa or more. In other words, they had an excellent strength. These continuously cast and rolled materials were processed by drawing as with Test example 3. The obtained wires had high strength and excellent toughness as with Test example 3. Some of the alloys having no added Ca showed partial black turning due to oxidation on the surface of the cast material. On the other hand, the alloys having added Ca showed no oxidation on the surface of the cast material.

It is commonly known that an AZ91 alloy material is usually difficult to process by extrusion. Nevertheless, in the present invention, by performing a rolling operation immediately after the continuous casting, it was possible to obtain a rod-shaped material and a multiangular material by using even an AZ91 alloy equivalent material. This is attributable to the fact that because the cooling rate at the time of the continuous casting is sufficiently higher than that of a semicontinuous casting, the increase in the amount of the solid solution of the added element, such as Al or Zn, decreases the tendency to grow the crystal grains even at the temperature range for the hot rolling operation, which is 350° C. or more.

Test Example 5

The continuous casting apparatus and rolling apparatus shown in FIG. 2 were used to produce a continuously cast material and a continuously cast and rolled material. The obtained continuously cast material was subjected to an examination of the structure. The obtained continuously cast and rolled material was subjected to an examination of the structure, strength, and plastic processability.

The magnesium alloy used in this test was an AZ91 alloy equivalent material. Its composition was analyzed by chemical analysis. The result was shown in wt. % as follows: Al: 9.0%, Zn: 1.0%, Mn: 0.2%, and the remainder: Mg and impurities including 0.0013% Ca, which was not added intentionally.

The specification of the continuous casting apparatus was the same as that in Test example 1. The specification of the melting furnace and the like was the same as that in Test example 2. A continuous casting was performed under the following conditions: melting temperature: 700° C., casting speed: 3 m/min, and cooling rate: 50 to 100° C./sec. Thus, a cast material having a cross-sectional area of about 300 $mm^2$ (width: 18 mm, height: 17 mm). The cross section of the obtained cast material was examined under an optical microscope. Although precipitated-out substances were observed, their size was 10 μm or less. It had a fine crystal structure.

The specification of the rolling apparatus was the same as that in Test example 2. The obtained cast material was heated at about 400° C. using a heating means and was sent to the rolling apparatus. The rolling operation was performed under the same condition as that in Test example 2. Thus, a long rolled material having a circular cross section with a diameter of 13 mm was obtained. The obtained continuously cast and rolled material was subjected to an examination under an optical microscope. When its structure was examined at the cross section, the cast structure disappeared completely and the structure was composed of a hot-rolled structure and a recrystallized structure. The average crystal grain diameter of the rolled material was measured to be 9 μm. In addition, although precipitated-out substances were observed in the rolled material, their size was 10 μm at the most. The tensile strength of the rolled material was measured to be 300 MPa.

The obtained continuously cast and rolled material was subjected to a processing of hot upsetting. More specifically, a specimen having a diameter of 8 mm and a length of 12 mm was taken from the above-described continuously cast and rolled material. The specimen was subjected to a hot upsetting at a temperature of 300° C. (upsetting speed: 12 mm/sec, upsetting rate: 80% (height: 2.4 mm)). The result showed that the upsetting was successfully performed without creating cracking and another defect on the surface of the specimen. On the other hand, for comparison, a commercially available extruded material (diameter: 8 mm, length: 12 mm) made of an AZ91 alloy was also subjected to the hot upsetting under the same condition. The result showed that the processing at an upsetting rate of 50% created surface cracking.

INDUSTRIAL APPLICABILITY

The present invention can offer a method of producing a magnesium-alloy material. The method can be utilized suitably for the production of a magnesium-alloy material having high strength and excellent plastic processability. The method can offer the alloy material with high productivity. In addition, a continuously cast and rolled material obtained through the production method of the present invention has excellent strength and toughness and therefore can be used suitably as a material for plastic processing. Furthermore, a magnesium-alloy material of the present invention obtained by performing a plastic processing on the continuously cast and rolled material not only has high strength and high toughness but also is light-weight. Consequently, it is suitable as a material for components of a portable apparatus, a motorcar, and the like. In particular, a magnesium-alloy wire of the present invention obtained by performing a drawing operation is suitable as a welding wire, a material for a screw, and a material for forging operation.

EXPLANATION OF THE SIGN

Figure 1A:
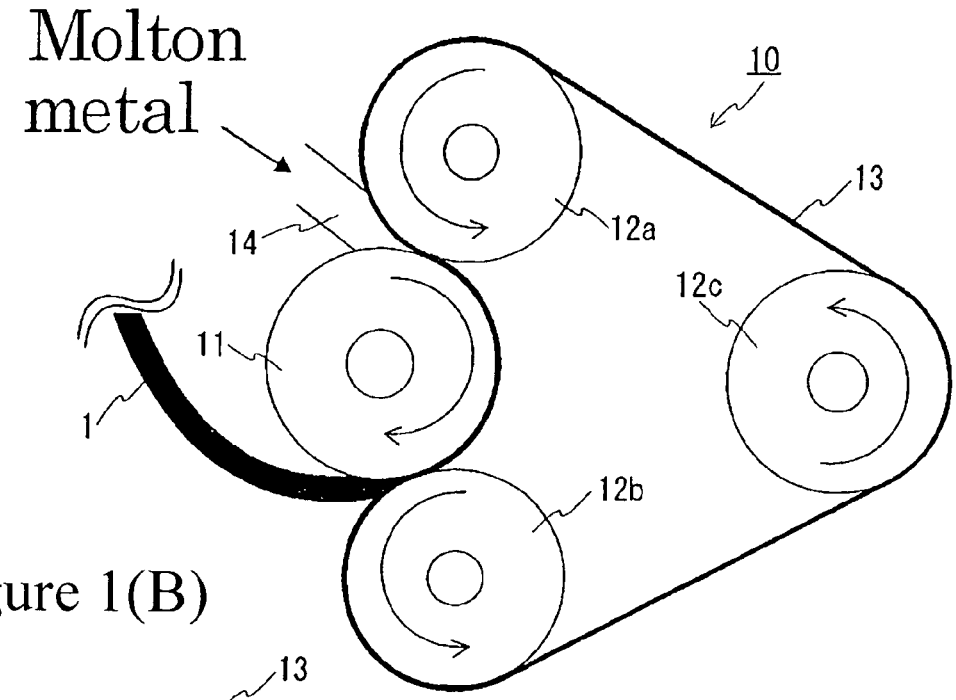
FIG. 1(A) is a schematic diagram showing the constitution of a continuous casting apparatus used in Test examples 1 to 5.
Figure 1B:
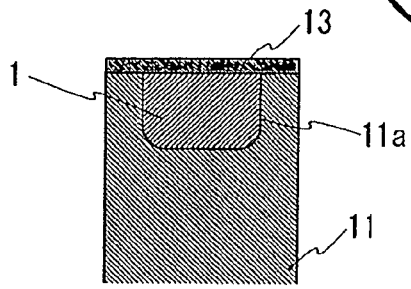
FIG. 1(B) is a partial cross section explaining a state in which a belt is placed on a casting roll.
Figure 2:
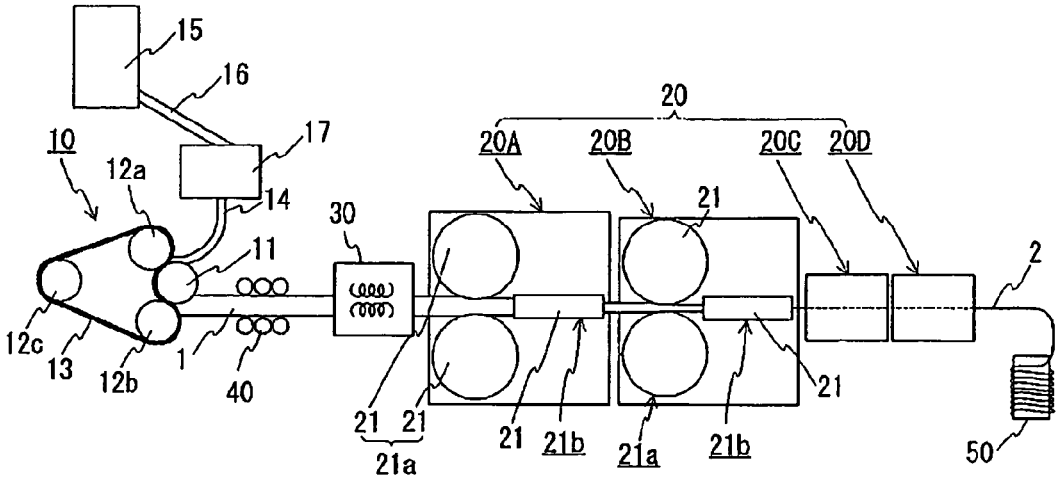
FIG. 2 is a schematic diagram showing the constitution of a production line system used in Test examples 2 to 5, the production line system being provided with a continuous casting apparatus and a rolling apparatus in tandem.

1: cast material; 2: rolled material; 10: continuous casting apparatus; 11: casting roll; 11*a*: groove; 12*a*, 12*b*: trailing roll; 12*c*: tension roll; 13: belt; 14: supplying section; 15: melting furnace; 16: launder; 17: tundish; 20: rolling apparatus; 20A, 20B, 20C, 20D: two-stage rolling machine; 21: rolling roll; 21*a*, 21*b*: rolling roll pair; 30: heating means; 40: guide roll; and 50: take-up device.

The invention claimed is:

1. A method of producing a magnesium-alloy material, the method comprising:

(a) a casting step for obtaining a cast material by supplying a molten magnesium alloy to a continuous casting apparatus provided with a movable casting mold; and (b) a rolling step for performing an area-reducing operation by supplying the cast material to one member selected from the group consisting of at least one roll group and at least two pairs of rolls;

in the rolling step, pressure being applied to the cast material using the rolls from at least three directions in the cross section of the cast material, wherein the rolling step is performed immediately after the casting step as a continuous step and the method is performed such that structure of the magnesium-alloy material becomes any one of a hot-rolled structure;

a mixed structure composed of a hot-rolled structure and a recrystallized structure, and a recrystallized structure, wherein in the rolling step, the rolling operation is performed by using a first pair of rolls having first rotation axes and a second pair of rolls having second rotation axes, and the first rotation axes are perpendicular to the second rotation axes so that the first pair of rolls applies pressure to the cast material from first two directions and the second pair of rolls applies pressure to the cast material from second two directions perpendicular to the first two directions.

2. A method of producing a magnesium-alloy material as defined by claim 1, wherein the magnesium alloy contains 0.002 to 5.0 wt % Ca.

3. A method of producing a magnesium-alloy material as defined by claim 1, wherein in the rolling step, the area-reducing operation is performed while the cast material is being heated at a temperature of at least 100° C. and at most 500° C.

4. A method of producing a magnesium-alloy material as defined by claim 1, wherein in the rolling step, the area-reducing operation is performed with a total reduction of area of 20% or more.

5. A method of producing a magnesium-alloy material as defined by claim 1, the method further comprising a drawing step for performing a drawing operation on a rolled material obtained through the rolling step.

* * * * *

UNITED STATES PATENT AND TRADEMARK OFFICE

CERTIFICATE OF CORRECTION

PATENT NO. : 7,666,351 B2
APPLICATION NO. : 11/631361
DATED : February 23, 2010
INVENTOR(S) : Taichiro Nishikawa et al.

It is certified that error appears in the above-identified patent and that said Letters Patent is hereby corrected as shown below:

Title Pg, Item (56) Foreign Patent Documents, foreign reference JP 2004-206646 should read JP 04-206646 A.

Signed and Sealed this
Twelfth Day of April, 2011

David J. Kappos

David J. Kappos
*Director of the United States Patent and Trademark Office*